US005108554A

United States Patent [19]

Deters

[11] Patent Number: 5,108,554

[45] Date of Patent: Apr. 28, 1992

[54] CONTINUOUS METHOD FOR PREPARING STEEL PARTS FOR RESIN COATING

[75] Inventor: Danny J. Deters, Clinton, Iowa

[73] Assignee: Collis, Inc., Clinton, Iowa

[21] Appl. No.: 780,402

[22] Filed: Oct. 17, 1991

Related U.S. Application Data

[63] Continuation of Ser. No. 579,468, Sep. 7, 1990, abandoned.

[51] Int. Cl.[5] ..... C23C 28/00

[52] U.S. Cl. ..... 205/145; 205/191; 205/917

[58] Field of Search ..... 204/23, 35.1, 37.1, 204/38.1, 38.7

[56] References Cited

U.S. PATENT DOCUMENTS

| | | | |
|---|---|---|---|
| 3,808,057 | 4/1974 | Labinski et al. | 148/6.2 |
| 3,833,486 | 9/1974 | Nobel et al. | 204/44 |
| 3,856,637 | 12/1974 | Kessler et al. | 204/29 |
| 4,003,760 | 1/1977 | Labinski et al. | 148/6.2 |
| 4,135,992 | 1/1979 | Fikentscher et al. | 204/55.1 |
| 4,547,268 | 10/1985 | Bruno et al. | 204/28 |
| 4,548,868 | 10/1985 | Yonezawa et al. | 428/446 |
| 4,548,872 | 10/1985 | Lavezzari | 428/633 |
| 4,591,416 | 5/1986 | Kamitani et al. | 204/35.1 |
| 4,902,387 | 2/1990 | Takeuchi et al. | 204/28 |

OTHER PUBLICATIONS

Brumer, PF Directory, pp. 201–206 (1990).
Richart, PF Directory, pp. 52–58 (1990).
Eppensteiner and Jenkins, Chromate Conversion Coatings, Metal finishing Guidebook and Directory, pp. 433–447 (1990).
Geduld, Metal Finishing, pp. 45–60, Aug. 1973.
Eckles, PF Directory, pp. 188–194 (1990).

*Primary Examiner*—John Niebling
*Assistant Examiner*—William T. Leader
*Attorney, Agent, or Firm*—Tilton, Fallon, Lungmus & Chestnut

[57] ABSTRACT

A method for applying a sequence of protective coatings to steel parts includes the steps of depositing a zinc coating, a chromate coating and a synthetic resin coating. The parts to be coated are supported on a hanger and carried thoughout the entire coating operation by a continous conveyer system. The zinc coating is electrolytically deposited from an alkaline non-cyanide electroplating bath to a thickness of from 0.05 to 0.2 mils. The zinc-coated parts are washed, and while still wet, are sprayed with an aqueous chromating solution. After rinsing and drying, a synthetic resin coating is applied to the chromate-coated parts by electrostatic powder spraying. The parts are then baked in an oven to fuse the resin coating. The method is particularly applicable to refrigerator racks.

5 Claims, 2 Drawing Sheets

CONTINOUS METHOD FOR PREPARING STEEL PARTS FOR RESIN COATING

CONTINUOUS METHOD FOR PREPARING STEEL PARTS FOR RESIN COATING

This application is a continuation of application Ser. No. 07/579,468, filed Sep. 7, 1990, now abandoned.

FIELD OF INVENTION

This invention relates to the application of protective coatings to steel parts, particularly successive layers of zinc, chromate, and synthetic resin. The method of this invention is particularly applicable to refrigerator racks or similar products.

BACKGROUND OF INVENTION

Steel parts such as refrigerator racks which are subjected to corrosive conditions are commonly provided with protective coatings. Such coatings may include a zinc layer applied by electroplating, a chromate layer over the zinc, typically applied by immersing the zinc-coated part in a chromating solution and final coating with a synthetic resin.

The sequence of successive zinc, chromate, and resin coatings has been used commercially for various products including refrigerator racks. For example, this sequence is disclosed in U.S. Pat. Nos. 3,808,057 and 4,003,760. As there described, the chromate coating is applied by immersion of the zinc-plated part in a chromating solution. Other methods of application of chromate layers have been suggested, such as spraying, brushing, swabbing or electrolytic methods: Eppensteiner and Jenkins, "Chromate Conversion Coatings", *Metal Finishing Guidebook and Directory* 1990, pages 433–447, at page 433.

The application of protective coatings to steel refrigerator racks or similar parts is believed to have been carried out by interrupting the coating procedure after the zinc electroplating. At a later time and in a separate production line, the zinc-coated parts have been subjected to chromating and thereafter to resin coating. As far as it is known, no continuous production method has been developed in which a steel part, such as a refrigerator rack, can be sequentially processed without interruption to apply successive zinc, chromate, and synthetic resin coatings.

SUMMARY OF INVENTION

A method is provided for preparing steel parts for resin coating in which without interruption the parts are successively electroplated with zinc and chromated. In the development of this invention, it was found that a higher rate of production of the coated parts can be obtained if the chromating solution is applied to the zinc-coated part by spraying the parts with a chromating solution.

In carrying out the chromating it was further found to be important to minimize transfer times between the final water rinsing after the zinc-plating and the application of the chromating spray. More specifically, the rinsed zinc-coated part should be transferred to the spray chromating operation without drying, that is, while still wet from the rinse water. This procedure assures that the zinc-coated surface will be fresh, bright and reactive. Then rapid spreading and reacting of the chromating solution on the zinc-coated parts is obtained.

Using the above-described sequence of steps, it was found not only that transfer times from the final water rinse after zinc-coating to the chromating spray coating should be made very short but that the chromating spraying, while still obtaining the formation itself could be of very short duration while still obtaining an effective chromate layer over the zinc layer. For example, a preferred transfer time of the rinsed part was is than 60 seconds, and the chromating spraying is completed in less than 120 seconds, while forming yellow chromate layers. In an optimized embodiment, the transfer time for the wet part is about 15 seconds, and spraying time for the chromating solution is about 30 seconds. Such fast sequences facilitate the fully continuous method of operation.

THE DRAWINGS

The method of this invention is illustrated in a preferred embodiment in the accompanying drawings in which.

DETAILED DESCRIPTION

Figure 1:
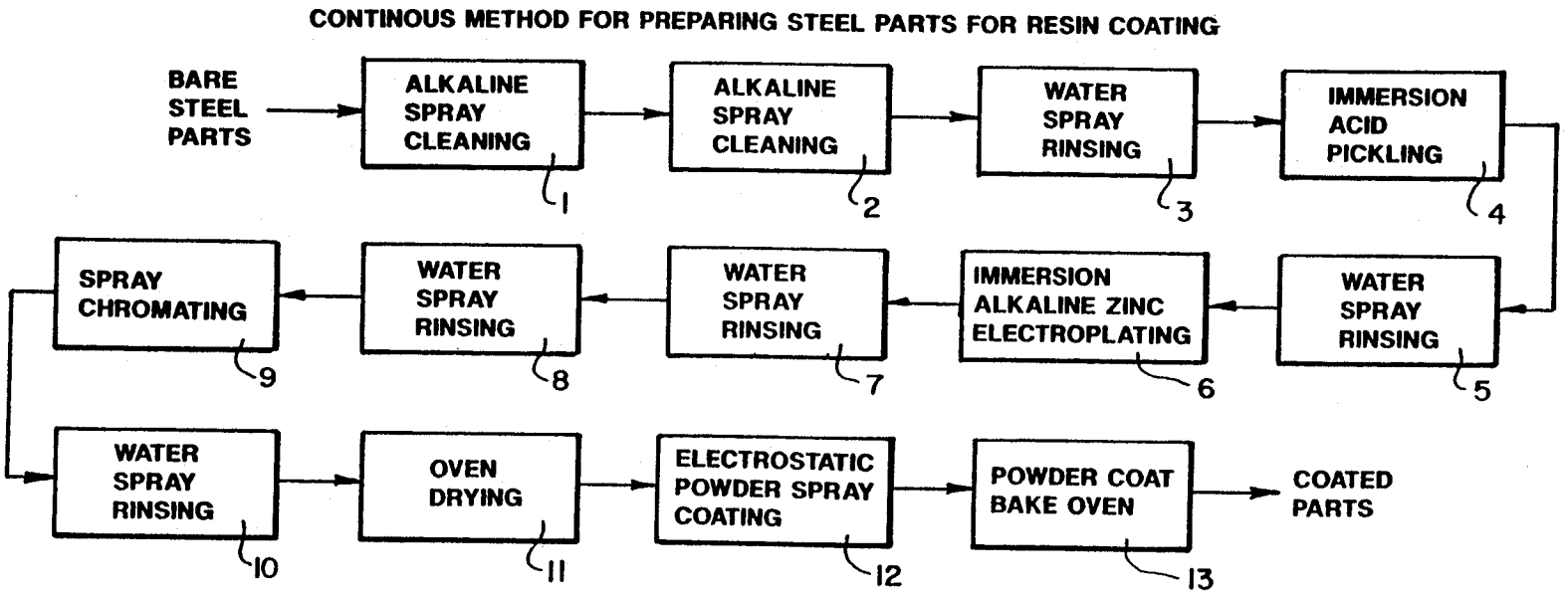
FIG. 1 is a block diagram flow sheet of the sequence of operations or stages in which the bare steel parts are continuously processed to form coated parts having successive layers of zinc, chromate and synthetic resin.

In accordance with the method of this invention, bare steel parts, such as refrigerator racks, are continuously processed to obtain a sequence of zinc, chromate and resin layers. The zinc coating is preferably carried out by electroplating, using an immersion-type alkaline, non-cyanide plating solution. Suitable electroplating baths and methods of operation are described in U.S. Pat. Nos. 4,135,992, 3,856,637 and 3,833,486. Alkaline, non-cyanide zinc plating is also described in literature references. See Geduld, *Metal Finishing*, August, 1973, pages 45–60; and Eckles, PF Directorv 1990, pages 188–194.

Zinc plating baths may be prepared by dissolving zinc anodes in caustic soda, or, alternatively, by dissolving zinc oxide in caustic soda. In using such aqueous plating baths, a temperature range of 70°–90° F. can be maintained, with a zinc metal concentration in the range from 0.70 to 1.2 ounces per gallon and a caustic soda (NaOH) concentration of from 9.0 to 11.0 ounces per gallon. A brightener may be included in the solution such as polyamine reaction products that are cationic in nature. Such brighteners are attracted to the cathodes along with the zinc ions and co-deposit with the zinc. For example, the Lea Ronal "Ronazinc T" brightener can be used at 0.50% by volume. The current density is not highly critical. For example, the anode can be operated at about 10 amps/ft$^2$ and the cathodes at about 25 amps/ft$^2$.

In the continuous coating operations of the present invention, it has been found satisfactory to employ a somewhat thinner than usual zinc coating. For example, instead of applying the zinc coating to a more typical thickness of 0.3 to 0.5 mils, it is preferred to apply the zinc coating to a thickness of from 0.05 to 0.2 mils, such as, for example, substantially 0.1 mil.

Chromating solutions of the kind useable in the method of the present invention were described by Brumer, *PF Directory* 1990, pages 201–206; and in Eppensteiner and Jenkins, cited above. These solutions contain chromic acid ($H_2CrO_4$) which provides hexavalent chromium. The solution may also contain an inorganic acid such as nitric acid, and providing a strongly acid pH, such as below 2.5, for example, around pH 2.0. In addition, such solutions should include one or more salts providing activator anions, which may include acetate, formate, sulphate, fluoride, nitrate, or phosphate anions. For example, sodium sulphate and sodium chloride may be employed in combination as activator salts together with the chromic acid and nitric acid. A suitable formulation is set out below.

| Ingredients | Quantities (lbs.) |
|---|---|
| Chromic Acid (HCrO) | 3.48 |
| Nitric Acid (42° Be') | 1.19 |
| Sodium Sulfate ($Na_2SO_4$) | 0.38 |
| Sodium Chloride (NaCl) | 0.06 |

The formulation of chromating reagents set out above can be used to form an aqueous chromating solution with concentrations the formation of from 0.5 to 2% by volume. Spray application of the chromating solution can be carried out with solution temperatures of from 60° to 100° F., and spraying times of from 15 to 60 seconds. In using the method sequence of this invention, it is preferred to carry out the spraying in less than 60 seconds, such as from 15 to 45 seconds.

An important feature of the continuous method is the transfer of the zinc-plated part while still wet from the final rinsing spray before the chromating stage. By application of a chromating spray to the parts with retained surface moisture. A rapid reaction of the chromating solution with the zinc-coated surfaces of the parts will be obtained.

This invention thereby provides an improved method for the continuous treatment of parts such as refrigerator racks to obtain successive coating layers of zinc, chromate and synthetic resin. Preferably the zinc layer is applied by electroplating and the part is washed thoroughly with water prior to the application of the chromate layer. Immediately following the last water washing of the zinc-plated part and while the parts are still wet, they are sprayed with the aqueous chromating solution, which preferably contains chromic acid together with nitric acid and at least one salt providing activator anions. Chromating spraying is carried out so as to wet the exterior surfaces of the parts. A yellow chromate layer is formed on the parts. The parts can then be continuously coated for synthetic resin coating by water rinsing and oven drying. Continuous resin coating of the thus prepared parts can be carried out. For example, an electrostatic powder spray procedure may be used followed by oven baking of the resin coated parts.

PREFERRED EMBODIMENT

A preferred embodiment of the method of this invention is illustrated in FIGS. 1 to 5. Looking first at FIG. 1, the bare steel parts, such as the refrigerator racks, are introduced onto a continuous conveyor system traveling first to a pre-cleaning stage 1 where the parts are washed with an alkaline spray. For example, the spray may be formed from American Chemco 834 at 2 to 4% by volume in water and applied at a temperature of 150°–190° F. Typically a 3% by volume concentration is used at a temperature of 180° F.

The part is next continuously conveyed to a second alkaline spray cleaning at stage 2, where the same spraying is repeated as in stage 1. Thereafter water spray rinsing is carried out in stage 3. This removes the alkaline cleaner from the parts. At stage 4 the parts are subjected to immersion acid pickling to remove rust and scale. An aqueous hydrochloric acid (22°Be') may be used at 50% by volume in water.

The pickled parts are next continuously subjected to water spray rinsing at stage 5, and are thereby prepared for the immersion alkaline zinc electroplating at stage 6. The electroplating bath may be maintained at a temperature of 70° to 90° F., such as around 80° F. The bath contains zinc metal ions at a concentration of 0.7 to 1.2 ounces of zinc per gallon together with sodium hydroxide at a concentration of 9 to 11 ounces per gallon. A brightener is also used such as preferably Lea Ronal "Ronazinc T" at a concentration of 0.5% by volume. The zinc coating is applied to a thickness range of from 0.5 to 0.2 mils. preferably about substantially 0.1 mil.

In stages 7 and 8, the zinc-coated part is subjected to water spray rinsing. Stage 8 is the final water rinsing prior to the spray chromating at stage 9. The stage 8 rinsed parts are rapidly transferred to the spray chromating. After the completion of electroplating at stage 6, the water rinsing at stages 7 and 8 can be completed in from 60 to 120 seconds, such as at about 30 seconds in each rinsing stage. The damp parts are transferred to chromating stage 9 in not over 60 seconds preferably in less than 30 seconds. For example, such transfer can be made in about 15 seconds.

A chromating solution thus can be prepared as described above, or a commercially available chromating solution can be used, such as the Frederic Gumm "Du-Chrome 154L". Chromating spraying in stage 9 can be completed in less than 120 seconds, and preferably in less than 60 seconds. For example, the spraying can be for about 30 seconds. The parts are thereby provided with a yellow chromatic layer, indicating a chromating film has been applied to and reacted with the zinc coating. The spray chromating is carried out at ambient temperature, such as ordinary room temperatures of from 60°–80° F.

Following the chromating stage 9, the coated parts are subjected to water spray rinsing at stage 10 then to oven drying at stage 11. The oven may be operated at a temperature of 250°14 400° F., such as around 350° F. The parts are thereby completely dried prior to powdering in stage 12. Electrostatic powder spray coating is carried out in stage !2 to apply resin powder to the coated parts. Average temperature are maintained in stage 12 of from about 65°–75° F. For example, an epoxy-polyester resin may be applied in admixture with fluidizing ingredients. For example, the spray coating powder may comprise "Glidden 3W108". Standard spray coating procedures and equipment are used, as described, for example, by Richert, *PF Directory* 1990, pages 52–58.

Following powder coating, the parts are baked in an oven at stage 13 to fuse the resin coating. Bake temperatures of around 375° F. can be used. Following baking, the completed parts are ready for use.

Figure 2:
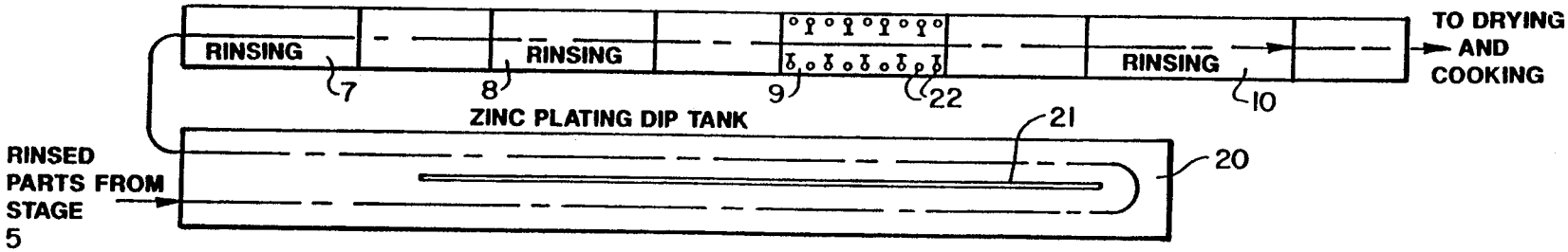
FIG. 2 is a fragmentary enlarged view of a portion of the flow sheet of FIG. 1, illustrating particularly the processing of the parts through the zinc plating dip tank followed by two rinsing stages, the chromating stage, and a subsequent rinsing stage.

In FIG. 2, stages 6 to 10 are illustrated in further detail. The rinsed parts in stage 5 are passed through a zinc plating dip tank 20, making a loop around a central electrode 21.

Figure 3:
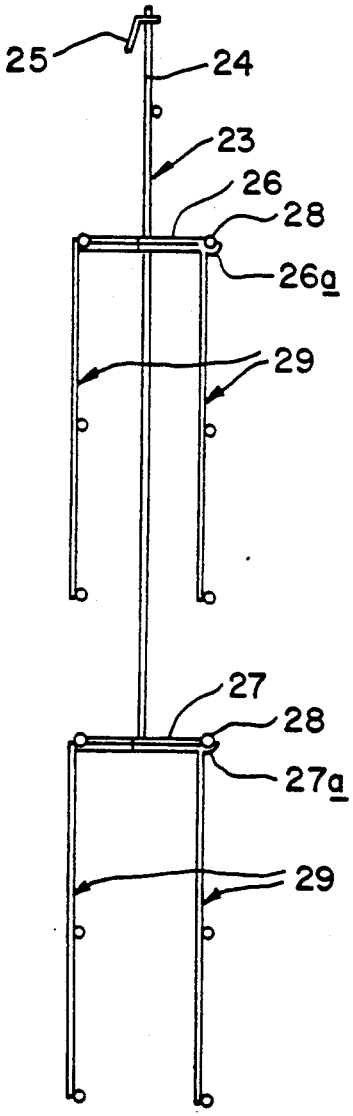
FIG. 3 is an enlarged view of a carrier rack on which four parts such as the refrigerator rack are supported.
Figure 4:
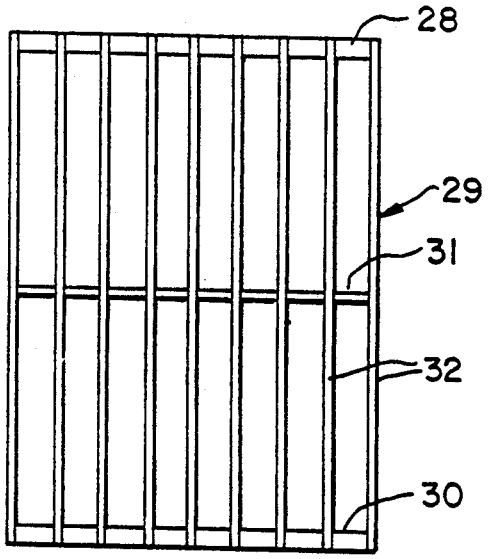
FIG. 4 is a plan view of a refrigerator rack as illustrated in elevation in FIG. 3.
Figure 5:
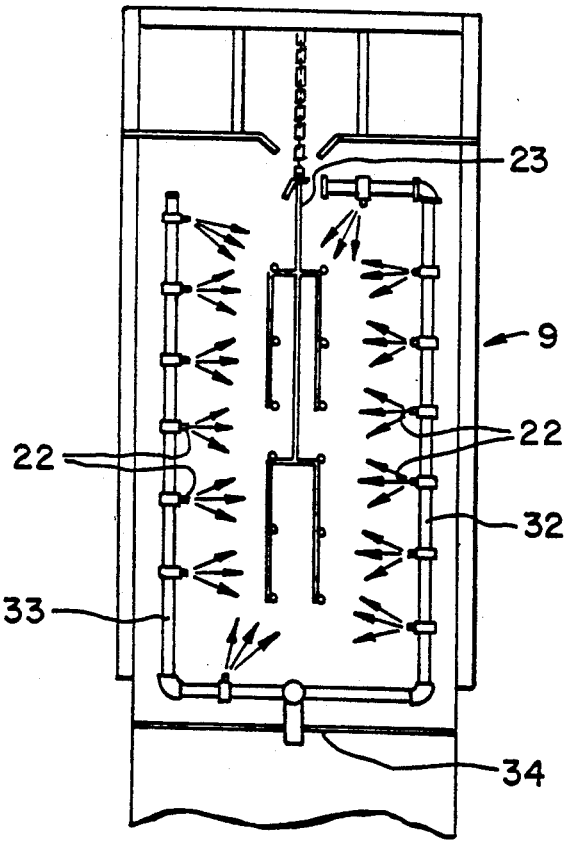
FIG. 5 is a elevational view of a chromate spraying apparatus, illustrating the exposure of the parts to multiple sprays, as the parts move through the chromating stage.

The continuous conveyor for the transfer of the refrigerator racks may include hangers as illustrated in FIG. 3 and 5. These hangers are designated generally by the letter 23. They includes a central vertically extending rod 24 which provides a hook 25 for attachment to the conveyor. Two cross bars 26 and 27 are provided, one at an intermediate position on rod 23 and the other at its lower end. The cross bars terminate in recesses **26*a* and 27*a* for receiving upper cross bars 28 of the refrigerator racks 29, as illustrated in FIG. 4. In addition to the upper and lower end bars 28 and 30 and a central cross rod 31, the racks can include a plurality of connecting rods 32**, which provide the refrigeration shelf. It will be understood, of course, such refrigerator racks may have various constructions and configurations.

The racks 29 supported on the hangers 23 are conveyed through a spray chromating apparatus as illustrated in FIG. 5. A battery of spray nozzles 22 are provided in vertically spaced relation along spray arms 32 and 33. Sprays direct multiple streams, as indicated by the arrow lines, to rapidly and completely expose the parts to the chromating solution. The chromating solution is supplied under pump pressure through pipe 34 for distribution to the spray arms 32 and 33.

In typical installation the times required for the stages described above are summarized below.

| Stage | Time |
|---|---|
| 1 | 30 sec. |
| 2 | 90 sec. |
| 3 | 30 sec. |
| 4 | 120 sec. |
| 5 | 30 sec. |
| 6 | 5 min. |
| 7 | 30 sec. |
| 8 | 30 sec. |
| transfer 8 to 9 | 15 sec. |
| 9 | 30 sec. |
| 10 | 30 sec. |
| 11 | 15 min. |
| 12 | 90 sec. |

-continued

| Stage | Time |
|---|---|
| 13 | 20 min. |

I claim:

1. An improved method for applying a sequence of protective coatings to exterior surfaces of steel parts in which the sequence includes a first zinc coating, an intermediate chromate coating, and a final synthetic resin coating, comprising:

(a) utilizing a continuous conveyor system including hanger means for carrying the steel parts through successive zinc, chromate, and resin coating operations, said parts remaining on the same hanger means throughout said coating operation;

(b) in the first coating operation by immersion alkaline non-cyanide zinc electroplating applying a zinc coating to said parts, said coating consisting of metallic zinc and having a thickness form 0.05 to 0.2 mils;

(c) in the next operation, water washing the zinc-coated parts and while the parts are still wet spraying them with an aqueous chromating solution containing chromic acid together with nitric acid and at least one salt providing activator anions, said chromating spraying wetting the exterior surfaces of said parts and being completed in not over 60 seconds with the formation of a yellow chromate layer on the parts; and (d) after water rinsing and drying the chromate-coated parts, applying a synthetic resin coating by electrostatic powder spray application, followed by oven baking of the applied resin coating, said parts remaining on said hanger means until the completion of said oven baking.

2. The improved method of claims 1 in which said parts immediately following said zinc coating operation are water washed and transferred to the chromate coating operation, the transfer time from said water washing into the sprayed chromating solution being less than 30 seconds.

3. The improved method of claims 1 or 2 in which said synthetic resin coating is formed from an epoxy-polyester resin.

4. The improved method of claim 3 in which said parts are refrigerator racks.

5. The improved method of claims 1 or 2 in which said parts are refrigerator racks.

* * * * *